United States Patent [19]

Wolff et al.

[11] 4,222,203

[45] Sep. 16, 1980

[54] MACHINING DEVICE AND METHOD

[75] Inventors: Friedrich Wolff, Remscheid; Hans-Joachim Hölter, Wuppertal; Hans-Peter Krumrey, Radevormwald, all of Fed. Rep. of Germany

[73] Assignee: Supfina Maschinenfabrik Hentzen KG, Remscheid, Fed. Rep. of Germany

[21] Appl. No.: 890,162

[22] Filed: Mar. 27, 1978

[30] Foreign Application Priority Data

Mar. 30, 1977 [DE] Fed. Rep. of Germany ..... 2714222

[51] Int. Cl.[2] ..... B24B 7/16

[52] U.S. Cl. ..... 51/3; 51/54; 51/67; 51/291

[58] Field of Search ..... 51/3, 54, 67, 291, 326, 51/131.1

[56] References Cited

U.S. PATENT DOCUMENTS

| | | | |
|---|---|---|---|
| 1,841,809 | 1/1932 | Heald | 51/3 |
| 2,333,411 | 11/1943 | Cramer | 51/105 R |
| 2,392,836 | 1/1946 | Cramer | 51/131.1 X |
| 2,660,006 | 11/1953 | Hegeman | 51/131.1 X |
| 2,660,840 | 12/1953 | Bergstrom | 51/131.1 |
| 2,909,009 | 10/1959 | Schmidt | 51/291 X |
| 4,024,672 | 5/1977 | Wieck | 51/67 X |

FOREIGN PATENT DOCUMENTS

| | | | |
|---|---|---|---|
| 285536 | 1/1971 | U.S.S.R. | 51/291 |
| 401474 | 2/1974 | U.S.S.R. | 51/291 |

*Primary Examiner*—Gary L. Smith
*Attorney, Agent, or Firm*—Edwin E. Greigg

[57] ABSTRACT

A method and device for machining the tappet collars of the inner rings of roller bearings by means of a frusto-conical cup wheel is proposed wherein such cup wheel is adjustable in the axial direction of the workpiece into engagement with the surface to be machined, is angularly adjustable about a remote axis perpendicular to the axis of the workpiece to provide for an adjustment in the inclination of the annular abrading surface of the cup wheel relative to the surface to be machined, and is supported for linear oscillating movement in a direction substantially parallel to the latter surface.

12 Claims, 3 Drawing Figures

MACHINING DEVICE AND METHOD

Figure 1:
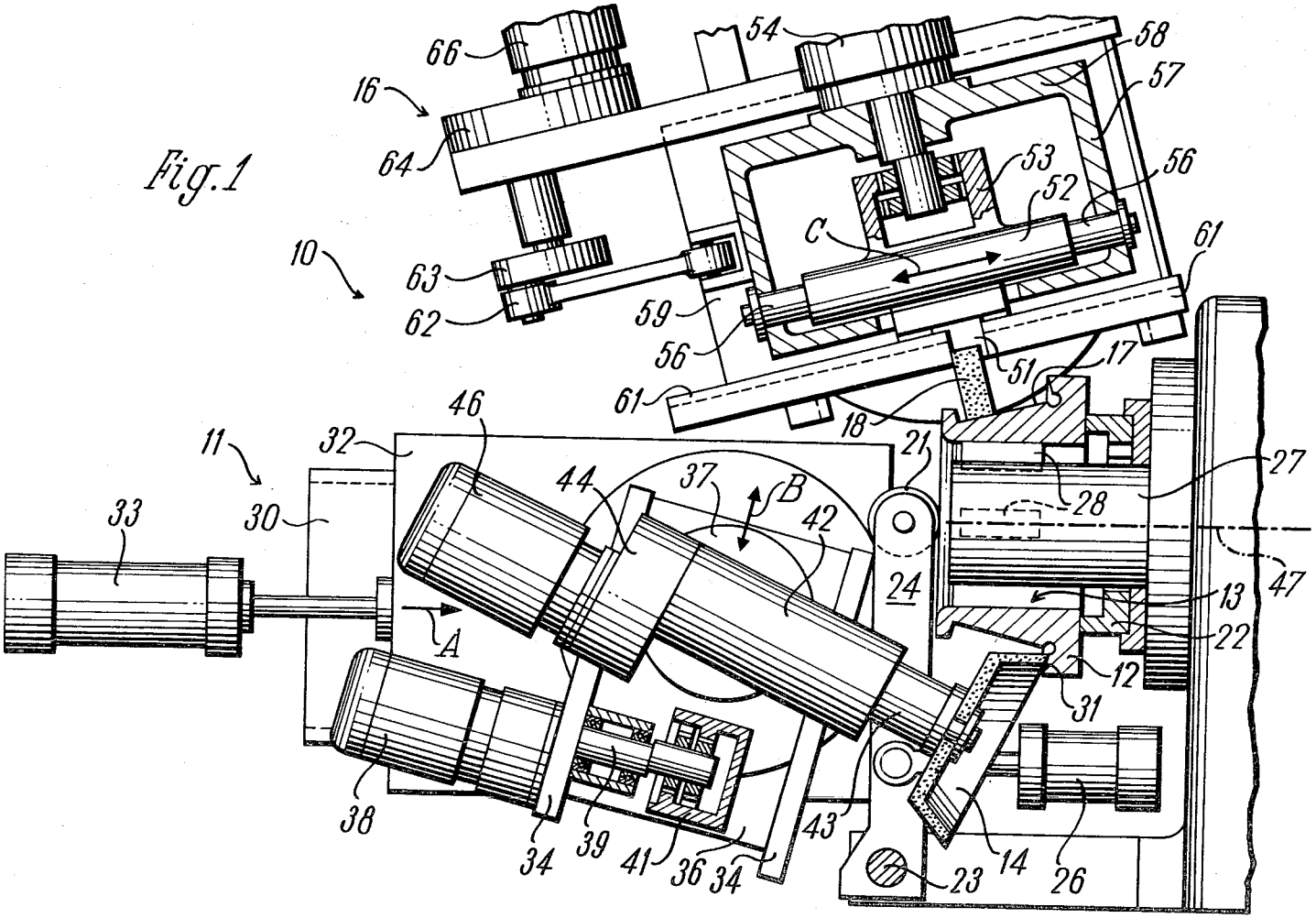

This invention concerns a method of and a device for the machining and fine machining tappet collars of the inner rings of tapered roller bearings.

The tappet collars of roller bearings are subjected to very high stresses, since they are required to withstand axial loads and since the conditions of motion at the surfaces of the tappet collars lead to unfavourable sliding conditions. For this reason it is necessary, in order to avoid local overloading and to ensure lubrication, for the contact surfaces of the rolling element and the tappet collars to be very accurately machined. Accordingly, the geometry of the surface of the tappet collar, both as regards its shape and also as regards its maintenance at an angle to the contact surfaces of the rolling element, must meet very stringent requirements. The load relationships at the inner ring and tappet collars of tapered roller bearings are especially critical.

One purpose of the present invention is to create a method and a device by means of which the tappet collars of the inner rings of tapered roller bearings can be very accurately machined by a simple method, and also a desired form of surface of the tappet collar can be obtained by a simple method.

According to one aspect of the invention, a method of machining tappet collars of internal rings of tapered roller bearings by means of a frusto-conical cup wheel having its axis of rotation inclined at an angle to the axis of rotation of the workpiece is characterised in that the angle of inclination of the axis of the cup wheel is determined by the external diameters of the cup wheel and tappet collar, the height of the tappet collar and the angle of inclination of the surface of the tappet collar relative to the normal to the axis of the workpiece, that the cup wheel is adjusted, in a direction parallel to the axis of the workpiece and during the machining process, is moved in a direction substantially parallel to the inclined tappet surface to execute a reciprocating motion relative thereto, the abrading surface of the cup wheel being narrower than the tappet collar surface.

According to another aspect of the invention, a device for machining tappet collars of internal rings of tapered roller bearings by means of a frusto-conical cup wheel having its axis of rotation adjustable at an angle relative to the axis of rotation of the workpiece is characterised in that the angle of inclination of the cup wheel is determined by the external diameters of the cup wheel and the tappet collar, the height of the tappet collar and the angle of inclination of the surface of the tappet collar, wherein the direction of adjustment of the cup wheel is parallel to the axis of the workpiece and wherein, during the machining process, the cup wheel can be moved parallel to the inclined tappet surface, and wherein the abrading surface of the cup wheel is narrower than the tappet collar surface.

A very simple and rapid machining of such tappet surfaces is possible by this means. For reasons of space it is more convenient for the cup wheel to be parallel to its generating line, which can be coincident with the axis of the workpiece, thereby simplifying the construction of the device. There are normally tappet surfaces on the inner rings of tapered roller bearings with a generating line which are not straight, but which form a circular region, with a radius which is dependent on the external diameter and the height of the tappet collar and on the resulting angle of inclination of the tappet surface. Concave contact surfaces are, however, indicated only when the front surfaces of the rolling elements of the tapered bearings are shaped to fit them. For this reason, in accordance with the invention, a substantially straight or preferably slightly convex generating line for the tappet collar is used, such that the reciprocating motion is approximately parallel to the resulting inclination of the tappet surface. This motion is controlled so as to provide the desired form of the generating line. As a consequence of the controlled displacement of the cup wheel approximately parallel to the straight line resultants of the desired generating line of the tappet collar, the radius of the generating line changes, as generated by the cup wheel, so that the tappet surface and generating line according to the control motion is composed of a multiple of the smallest sectors of the circle, in such a manner that the generating line is mainly straight, or convex, or as desired.

It is understood that, in accordance with the control of the motion, in which the front surface of the cup wheel covers the whole width of the tappet collar, corresponding to the amplitude of the motion and dependent on the thickness of the cup wheel, it is also possible, in accordance with the invention, to produce tappet surfaces with other shapes. It is always assumed that the cup wheel is pressed with constant pressure against the tappet collar which is to be machined with precision.

In accordance with a further preferred form of application of the present invention, a machining process is carried out on the bearing surface of an inner ring simultaneously with the machining of the tappet collar of this inner ring. This machining of the bearing surfaces can be carried out by means of short-stroke honing, for example. In this manner the machining of inner rings can be carried out in a shorter time, and the device necessary for machining entails smaller costs than does provision for two separate machining processes.

Figure 2A:
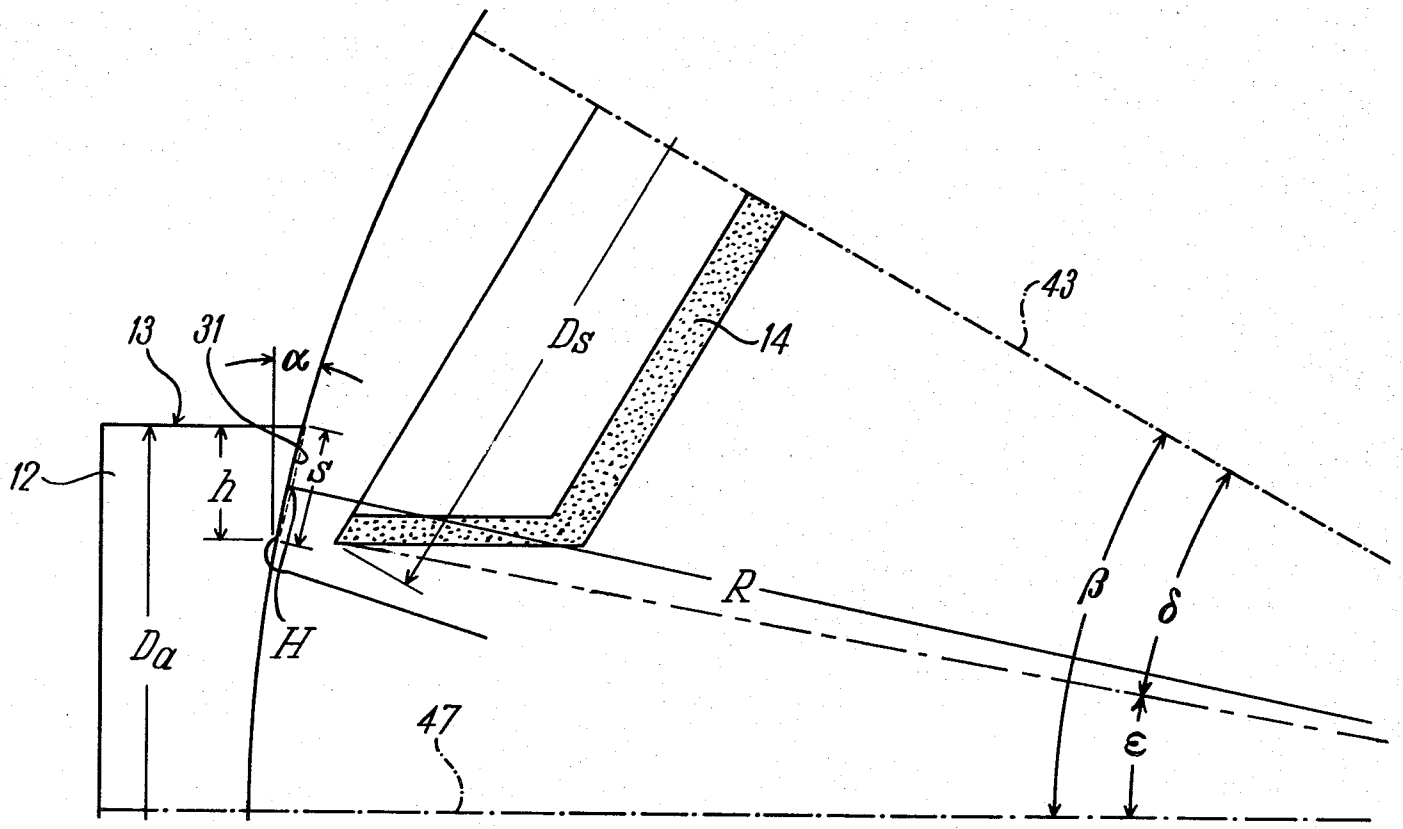
Figure 2B:
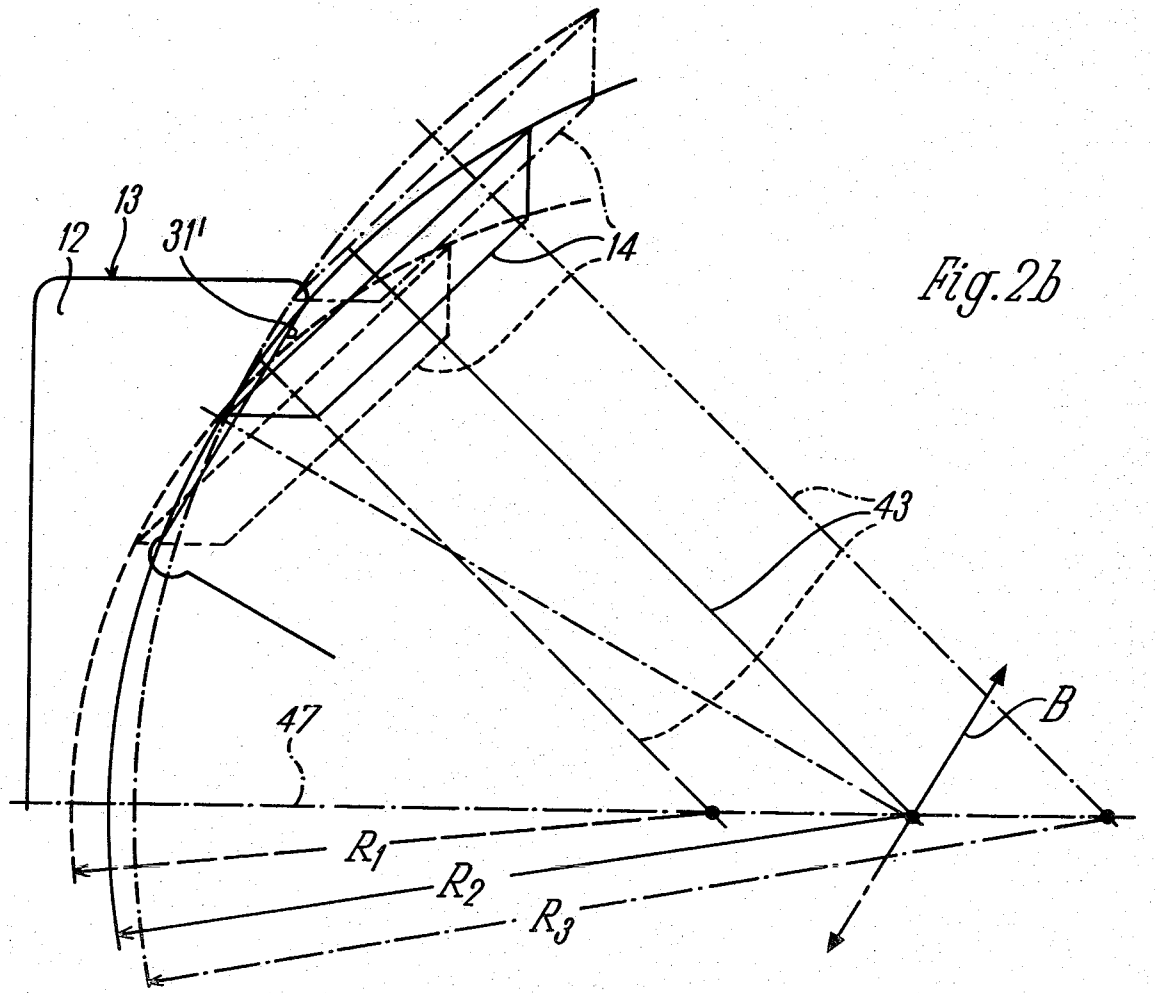

The invention will now be described further by way of example only, with reference to the accompanying drawings illustrating one example thereof and in which:

FIG. 1 an overall view, divided into partial sections, of a device for machining of the tappet collar surfaces and bearing surfaces of the inner ring of a tapered roller bearing;

FIG. 2*a* a schematic representation, in section, of the geometrical arrangement of the cup wheel of the tappet collar to be machined; and FIG. 2*b* a section similar to FIG. 2*a*, but with a schematic representation of the reciprocating motion of the cup wheel and of the convex surface of the tappet collar so formed.

The device shown in the drawing serves for finishing and machining, i.e. fine abrading and finishing of the tappet collar surfaces of an inner ring for the bearing elements of roller bearings, where the finishing process is carried out by means of a cylindrical or frustrum-shaped cup wheel. By means of the device, it is possible to machine the tappet collar surfaces in the desired manner with regard to precision and shape, i.e. concave, straight, or convex, in principle independently of their size.

Referring now to the drawings, FIG. 1 shows a machine 10 which is provided not only with a device 11 for machining the tappet collar 12 of an inner ring 13 of a tapered roller bearing by means of a frusto-conical cup wheel 14, but also with a device 16 which serves for the simultaneous short-stroke honing of the bearing surface 17 of this inner ring 13 by means of a hone 18. Devices 11 and 16 are fixed to a common machining table, which is not specially shown in the drawing, and are so spatially arranged in relation to each other and to the workpiece 13 that they can operate simultaneously, and that therefore finishing of the tappet collar 12 and honing of the bearing surface 17 of the inner ring 13 are both possible. The workpiece, i.e. the inner ring 13 is pressed against the front surface of a bell-shaped driver 22 of U-shaped cross-section by means of two rollers 21 during the machining process; driver 22 is connected to a rotatable drive shaft, not shown. Rollers 21 are attached to a single-armed swivel lever 24, pivotal about an axis 23, under the control of a hydraulic equipment 26, to load the rollers against the workpiece 13, so that the workpiece can be driven round by a frictional force. Radial fixing of the workpiece 13 is affected by means of a retractable peg 27 which passes through the driver 22; this peg engages the bore of the inner ring 13 and, by means of radial shoes 28, centres such ring and holds it in position, the shoes being pressed against the inner surface of the inner ring 13 by centrifugal force rotation. The inner ring 13 is held in such a manner that the target surface 31 of the tappet collar 12 to be machined is directed towards the free end of this holding and driving device, and therefore to the pressure roller 21. On the workpiece 13 the tappet collar 12 extends radially outwardly beyond the opposite, free end since the bearing surface 17 of the inner ring 13 of a tapered roller bearing to be machined is conical inwards.

The device 11 for finishing the tappet surface 31 is provided with a slider arrangement, the guide 30 of the main slider 32 being rotatably mounted on the machine stand and such slider 32 being movable by means of a fluid-operated piston cylinder unit 33 for effecting the positioning of the frustrum-shaped cup wheel. A transverse slider 36 is mounted in angularly adjustable guide bars 34 on main slider 32, and is movable longitudinally of such guide bars. A driving motor 38 is fixed on one of the guide bars and the drive shaft 39 of such motor is connected on one part of an eccentric drive 41, the other part of such drive being fixed to the transverse slider 36. The eccentric drive 41 is such that, when provided with the appropriate interchangeable eccentric plate, a requisite reciprocating motion of the transverse slider 36 can be effected. A guide sleeve 42 of a driving spindle 43 is fixed on the transverse slider 36 for angular adjustment in a plane parallel to such slider, one end of the spindle being connected with drive motor 46 through a drive connection 44, and the other end supporting the tool, that is to say the frustrum-shaped cup wheel 14, in non-rotatable relationship thereto. The fact that the sliders 32 and 36 can be moved and rotated relatively to each other and to the driving spindle 43 about the same vertical axis 37 makes it possible to adjust the cup wheel 14 with three degrees of freedom in the same plane relative to the workpiece 13. Whilst the main slider 32 is intended for adjustment of the cup wheel 14, which in the example illustrated takes place parallel to the workpiece axis 47 (Arrow A), during machining of the inner ring 13 of the tapered roller bearing the transverse slider 36 is caused to reciprocate with a straight line motion approximately parallel to the desired tappet surface 31, as shown by the double arrow B; an oscillatory motion therefore take place. The driving spindle 43 is fixed at a definite angle of inclination relative to the axis of the workpiece, so that the larger diameter of the cup wheel 14 touches the whole width of the tappet surface 31. All the parts which can be adjusted in relation to each other are provided with scales, not illustrated, from which the settings can be read. The rotational axes of the sliders 32 and 36 and of the driving spindle 43, which coincide in this case, can also be separate. As shown in FIG. 1, the cup wheel 14 is so shaped and positioned that the generatrix of the frusto-conical form, during machining of the tappet surface 31, is in the main kept parallel or nearly so to the axis 47 of the workpiece, so that during machining of the tappet surface 31 and with the driving spindle 43 set obliquely for this purpose, it is possible to adjust the cup wheel in a direction parallel to the axis 47. In each case, adjustment takes place parallel to the generating line of the cup wheel, which need not necessarily coincide with the axis of the workpiece. This depends mainly on the construction of the inner ring to be machined. With this arrangement the abrading surfaces of the cup wheel 14 and of the tappet surface 31 are not parallel to each other.

FIG. 2*a* shows the geometrical arrangement and the dimensions of the frustom-shaped cup wheel 14 and of the inner ring 13 to be provided with the tappet collar. It can be seen that the tappet collar should have an external diameter $D_a$, the surface of the tappet collar, a chord length s and height h, and be at an angle of inclination $\alpha$ to the normal to the workpiece. The cup wheel 14 has a maximum external diameter $D_s$ and is inclined at an angle $\beta$ to the workpiece axis 47. The magnitude of this angle $\beta$ is dependent on the angle of inclination $\alpha$ of the tappet collar surface 31, the external diameter $D_a$, the height h, and the external diameter $D_s$. This angle $\beta$ is determined approximately by means of a simplified process of calculation, in which no allowance is made for the transverse motion of the cup wheel 14 as shown by double arrow B, from the sum of angles $\delta$ and $\epsilon$, defined by:

$$\sin \delta = D_s/2/R$$

$$\text{and } \sin \epsilon = (D_a/2 - h)/R$$

where R is the radius given to the generating line of the tappet collar suface 31 during the machining process. For the previously given position of the tappet collar 12, the relationship between the radius R and the angle of inclination $\alpha$ of the surface to be machined is:

$$R = (D_a/2 - h/2)/\sin \alpha$$

The degree of concavity (H) in the centre of the tappet collar, which corresponds to the height of an arc over length s, is calculated by:

$$H = R \cdot (1 - \sqrt{1 - (s/2R)^2})$$

in which the finite thickness of the abrading surface of the abrading wheel is neglected.

It will be seen that, if during machining the rotating cup wheel 14 and its driving spindle 43 are maintained in a fixed position, a tappet collar surface 31 will be produced with a fairly strongly concave generating line. As is seen from FIG. 2*b*, it is possible to change the shape of the tappet collar surface 31 and its generating line, by ensuring that, during machining and fine machining, the cup wheel 14 is moved to and fro in a straight line, substantially parallel to the desired tappet collar surface 31, and therefore substantially at the same angle of inclination $\alpha$ to the normal to the axis of the workpiece. By this means different radii $R_1$, $R_2$, and $R_3$ for example come into operation, which affect the form of the tappet surface. Depending on the way in which the transverse slider 36 moves with time, by means of the eccentric drive 41, or dependent on the form of interchangeable control curve or depending on the magnitude of the adjustable stroke length, it is possible to obtain forms of tappet collar surface with slightly concave, to straight, to slightly convex generating lines. The form to be aimed at depends very much on the data, i.e. on the front surface of the roller element used. In the preferred example shown in FIG. 2*b*, a slightly curved, concave surface 31' is obtained, which is a considerable advantage for driving of roller bearings, since the motion between tappet collar and bearing element is essentially only linear or even at a point, so that friction is in principle avoided. FIG. 2*b* shows the production of this curved surface in theory by means of three positions of the cup wheel. By displacement of the cup wheel as shown by arrow B the quantity of material removed from the inner and outer regions of the tappet collar 12 can be increased, since in one case the smaller radius $R_1$ and in the other case the larger radius $R_3$ is produced. We can therefore see that with an infinitely large number of positions of the cup wheel (instead of the three shown in the drawing), i.e. with continuous displacement, an infinite number of such small surface zones is produced, with the result that the curved surface 31' is formed.

The arrangement 16 is shown in FIG. 1 for the simultaneous honing of the surface of the workpiece 17 includes a honing stone 18, which can be moved to and fro over the whole of the bearing surface 17 in the axial direction thereof, a small amplitude, high frequency oscillatory motion being superimposed on this reciprocating motion. For this purpose the honing stone 18 is fixed in a parallel guide 52 by means of a holder 51, the guide being connected by an eccentric drive 53 to a driving motor 54, which puts both elements of the honing stone 18 into a rapid, i.e. high frequency, and small amplitude oscillation, in the same direction as the longitudinal oscillation, but which is nevertheless very short in comparison to such longitudinal oscillation. The parallel guide 52 is supported by spindles 56 carried by a housing 57, motor 54 for the high frequency oscillation of the honing stone being mounted in wall 58 of such housing. The housing 57 is connected to slider 59, which can be displaced with respect to the guide 61. The large amplitude reciprocating motion of the slider 59 parallel to the bearing surface 17 is effected by means of a rod 62 driven by an eccentric disc 63 via a drive 64 from a motor 66, the reciprocatory motion being in the direction of the double arrow C and, the honing stone 18 moving over the full axial length of the bearing surface 17. The whole arrangement 16 can be moved in a direction perpendicular to the bearing surface 17 to be machined, by means of a further slider, not shown, fixed to the machine table, so that, on changing of the workpiece 13, the device 16 can be withdrawn from the locality of the workpiece and later moved to the workpiece. For changing of the workpiece 13 the pressure rollers 21 are removed and the peg 27 withdrawn from the driving spindle of the workpiece so that the completely machined workpiece 13 can fall into a removal channel not shown in the drawings. For machining of workpieces of different diameters, both arrangements 11 and 16 can be used as required. Both devices 11 and 16 can be, as in FIG. 1, in one plane and also in mutually perpendicular planes or in planes in any desired angle of inclination.

By means of the machine shown in FIG. 1 in accordance with the invention, it is therefore possible by a simple method, to machine simultaneously the inner ring of a tapered concial bearing 13 and the bearing surface 17 and the tappet collar surface 31, to the most demanding tolerances, i.e. honing and finishing together.

It is understood that in the machine in accordance with the invention, the device for holding of the workpiece can be interchangeable so that inner and outer rings can be held in position. In addition the drive to the rings to be machined can be by means of magnetic or other methods, such as membranes or tension pegs, so that magentic holding can permit the pressure roller 21 to be dispensed with. Drive of the longitudinal slider can also be effected by pneumatic or mechanical means, e.g. by springs. The individual sliders and the spindles can also be rotated about axes which can be displaced with respect to each other.

What is claimed is:

1. A method of machining tappet collars of internal rings of tapered roller bearings comprising the steps of:

rotatably supporting the internal ring of a roller bearing provided with a tappet collar having a surface to be machined;

providing a frusto-conical cup wheel having an abrading surface narrower than said tappet collar surface;

disposing said cup wheel with its axis of rotation inclined at an angle to the axis of rotation of said inner ring;

positioning said cup wheel with its axis having an angle of inclination determined in accordance with the equation:

$$\beta=\delta+\text{arc sin}\,(\tfrac{1}{2}D_a-h)/R$$

where R is the radius of the radial generating line of the surface to be machined and is given by:

$$R=\tfrac{1}{2}(D_a=h)/\sin\alpha$$

and where $\delta$ is determined by the dimensions of the cup wheel;

adjusting the position of said cup wheel in a direction parallel to its generatrix; and moving said cup wheel during the machining operation in a direction substantially parallel to the inclined tappet collar surface to execute a reciprocating motion along with width thereof and relative thereto.

2. A method in accordance with claim 1, including the step of controlling said reciprocating motion of said cup wheel during said moving step in accordance with the desired form of said tappet collar surface.

3. A method in accordance with claim 1, wherein said internal ring includes a bearing surface and including the step of performing a short-stroke honing operation on said internal ring bearing surface simultaneously with said machining operation on said tappet collar.

4. A device for machining tappet collars of internal rings of tapered roller bearings comprising, in combination, means for rotatably supporting the internal ring of a tapered roller bearing provided with a tappet collar having a surface to be machined, a frusto-conical cup wheel having an abrading surface narrower than said tappet collar surface, means for rotatably supporting said cup wheel with its axis of rotation inclined at an angle to the axis of rotation of said internal ring supporting means, means for supporting said cup wheel with its axis having an angle of inclination determined and further including machine stand, and wherein said means for moving said cup wheel include a drive mechanism having a driving spindle connected to said cup wheel, a longitudinal slider rotatably mounted on said machine stand and a transverse slider supported on said longitudinal slider connected to said drive mechanism for the reciprocating motion of said cup wheel.

5. A device as claimed in claim 4 characterised in that, as a result of the reciprocating motion of the cup wheel generally parallel to the resulting inclination of the tappet collar surface the radius and hence the angle of inclination, of the individual segments of the generatrix of the tappet collar surface can be changed.

6. A device as claimed in claim 5, wherein said means for moving said cup wheel during said machining operation is adapted to produce, as a result of the reciprocating motion of said cup wheel, a convex tappet collar surface by removal of more material from the inner and outer edges of said tappet collar surface than from the central region of said tappet collar surface as a result of the differing radii.

7. A device as claimed in claim 4, characterised in that said frusto-conical cup wheel is arranged with its generatrix parallel to the axis of said internal ring.

8. A device as claimed in claim 4, characterised in that in an operative position, as during machining, the abrading surface of said cup wheel and the inclined tappet collar surface are inclined at a small angle to each other.

9. A device as claimed in claim 4, including a slider guide and an eccentric drive having a driving shaft fixed to said transverse slider with said driving shaft of said eccentric drive located on said slider guide.

10. A device as claimed in claim 4, including fluid-operated means for driving said longitudinal slider in the desired direction.

11. A device as claimed in claim 4, wherein said driving spindle and said sliders are adapted for rotation about a common axis.

12. A device as claimed in claim 4, wherein said internal ring includes a bearing surface and including short-stroke honing means for honing said internal ring bearing surface simultaneously with the machining operation performed on said tappet collar surface.

* * * * *